US010375489B2

(12) United States Patent
Rountree, Sr.

(10) Patent No.: US 10,375,489 B2
(45) Date of Patent: Aug. 6, 2019

(54) AUDIO SYSTEM WITH INTEGRAL HEARING TEST

(71) Applicant: Robert Newton Rountree, Sr., Cotopaxi, CO (US)

(72) Inventor: Robert Newton Rountree, Sr., Cotopaxi, CO (US)

( * ) Notice: Subject to any disclaimer, the term of this patent is extended or adjusted under 35 U.S.C. 154(b) by 87 days.

(21) Appl. No.: 15/816,950

(22) Filed: Nov. 17, 2017

(65) Prior Publication Data

US 2018/0270590 A1 Sep. 20, 2018

Related U.S. Application Data

(60) Provisional application No. 62/473,070, filed on Mar. 17, 2017.

(51) Int. Cl.
*H04R 25/00* (2006.01)
*H04S 7/00* (2006.01)

(52) U.S. Cl.
CPC ..... *H04R 25/505* (2013.01); *H04R 25/30* (2013.01); *H04R 25/554* (2013.01); *H04R 25/70* (2013.01); *H04S 7/307* (2013.01); *H04R 2205/041* (2013.01); *H04R 2225/43* (2013.01); *H04R 2225/55* (2013.01)

(58) Field of Classification Search
CPC .... H04R 25/505; H04R 25/30; H04R 25/554; H04R 25/70; H04R 2205/041; H04R 2225/43; H04R 2225/55; H04S 7/307
USPC ..... 381/98, 320
See application file for complete search history.

(56) References Cited

U.S. PATENT DOCUMENTS

| | | | | |
|---|---|---|---|---|
| 3,784,750 | A * | 1/1974 | Stearns | H03G 9/02 381/106 |
| 3,989,904 | A * | 11/1976 | Rohrer | A61B 5/121 381/320 |
| 5,083,312 | A * | 1/1992 | Newton | H04R 25/558 381/320 |
| 5,500,902 | A * | 3/1996 | Stockham, Jr. | H03G 9/005 381/106 |
| 8,005,246 | B2 * | 8/2011 | Ribic | H04R 25/35 381/316 |
| 9,532,154 | B2 | 12/2016 | Bang et al. | |
| 2005/0078838 | A1 * | 4/2005 | Simon | A61B 5/121 381/98 |
| 2008/0192971 | A1 | 8/2008 | Tateno et al. | |
| 2009/0060209 | A1 * | 3/2009 | Takeishi | H04R 3/04 381/17 |
| 2010/0303269 | A1 * | 12/2010 | Baechler | H04R 25/70 381/321 |

(Continued)

OTHER PUBLICATIONS

TLV320AIC3256 Ultra Low Power Stereo Audio Codec With Embedded miniDSP (Nov. 2014).

*Primary Examiner* — Vivian C Chin
*Assistant Examiner* — Douglas J Suthers
(74) *Attorney, Agent, or Firm* — Robert N. Rountree

(57) ABSTRACT

An audio circuit with an integral hearing test is disclosed. The circuit includes at least one variable gain amplifier (VGA) coupled to receive an audio signal and a plurality of filters. Each filter is coupled to the at least one VGA and configured to filter an output signal from the at least one VGA. A processor is coupled to the VGAs and configured to apply a selected frequency to the at least one VGA in a test mode and to control a gain of the at least one VGA in a normal mode.

20 Claims, 10 Drawing Sheets

(56) References Cited

U.S. PATENT DOCUMENTS

| | | | | |
|---|---|---|---|---|
| 2012/0008791 | A1 | 1/2012 | Gerkmann et al. | |
| 2013/0142366 | A1 | 6/2013 | Michael et al. | |
| 2013/0216062 | A1 | 8/2013 | Martin et al. | |
| 2014/0086434 | A1* | 3/2014 | Bang | A61B 5/123<br>381/98 |
| 2015/0208956 | A1 | 7/2015 | Schmitt | |
| 2015/0256948 | A1* | 9/2015 | Nielsen | H04R 25/75<br>381/320 |
| 2016/0277855 | A1 | 9/2016 | Raz | |

* cited by examiner

AUDIO SYSTEM WITH INTEGRAL HEARING TEST

This application claims the benefit under 35 U.S.C. § 119(e) of Provisional Appl. No. 62/473,070, filed Mar. 17, 2017, which is incorporated herein by reference in its entirety.

BACKGROUND OF THE INVENTION

Embodiments of the present embodiments relate to an audio system with filters programmed in response to an integral hearing test.

Normal human hearing is generally considered to range from 20 Hz to 20 kHz. It is typically displayed on a logarithmic scale in units of decibels SPL (Sound Power Level) or simply dB. For example, 0 dB corresponds to a power of $10^{-16}$ watts/cm$^2$. This is about the weakest sound detectable by the human ear. Normal speech may be around 60 dB, and hearing damage may occur around 140 dB.

Human hearing is most sensitive to sounds between 1 kHz and 4 kHz. But speech comprehension also depends on higher frequency components found in consonants. For example, consonants such as f, j, s, v, and z are often important to speech comprehension but comprise frequencies from 3 kHz to 8 kHz. With increasing age, many people lose the ability to hear these higher frequency components and experience diminished speech comprehension. Hearing aids, telephone amplifiers, and other devices may improve comprehension. Some of these devices, however, only amplify the entire bandwidth from 20 Hz to 20 kHz. Thus, midrange frequencies from 1 kHz and 4 kHz may still overpower higher frequencies that assist in speech comprehension. Some programmable hearing aids are designed to selectively amplify frequency bands corresponding to individual hearing loss and, thereby, improve hearing and speech comprehension. However, these hearing aids typically require an audiogram from a trained audiologist. Furthermore, they must be reprogrammed as hearing is further diminished. The inevitable result is a significant time and cost overhead for users.

Finally, many hearing aids will not work with simple devices such as telephone handsets or portable electronic devices with earphones. Simply increasing the volume of a telephone amplifier often produces feedback resulting in a loud squeal. Furthermore, many hearing aids are less effective in groups where several people may be talking. Thus, there is a significant need for improved, affordable hearing devices that will enhance speech comprehension without the need of a trained audiologist.

BRIEF SUMMARY OF THE INVENTION

In an embodiment of the present invention, an audio circuit is disclosed. The circuit includes at least one of variable gain amplifier (VGA) coupled to receive an audio signal. Each of a plurality of filters is coupled to the at least one VGA and configured to filter an output signal from the at least one VGA. A processor is coupled to the at least one VGA and configured to apply a selected frequency to the at least one VGA in a test mode and to control a respective gain of the at least one VGA in a normal mode.

In another embodiment of the present invention, an audio circuit is disclosed having a plurality of band-specific circuits coupled to receive a respective frequency in a test mode of operation and produce a respective band-specific output signal. A processor is configured to store a gain of each respective band-specific output signal in response to a respective user input signal. An input circuit is configured to apply a signal to each band-specific circuit during a normal mode of operation, wherein each band-specific circuit produces a respective normal output signal having the respective stored gain.

DETAILED DESCRIPTION OF THE INVENTION

Embodiments of the present invention provide significant advantages for an audio circuit with selective frequency control and an integral hearing test.

Figure 1:
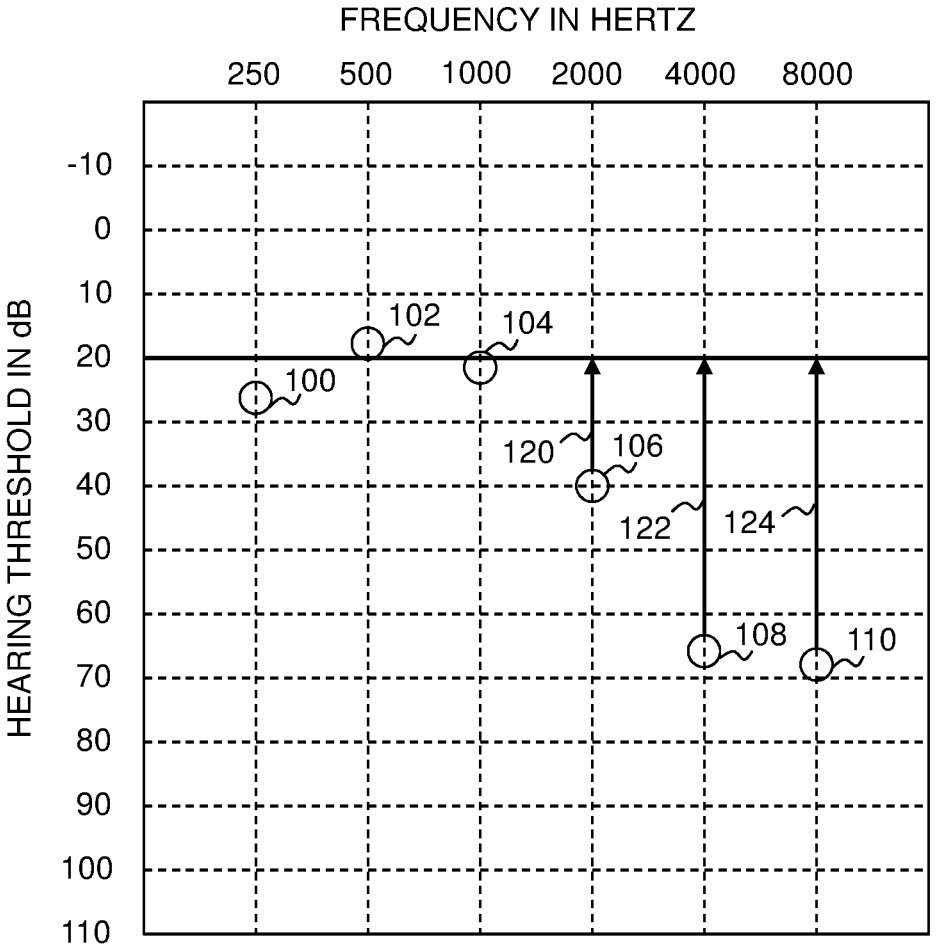
FIG. 1 is a typical audiogram of a user showing moderate hearing loss.

Referring to FIG. 1, there is a typical audiogram of a user with moderate hearing loss from 40 dB to 70 dB at 4 KHz 108 and 8 KHz 110. The audiogram also shows mild hearing loss from 20 dB to 40 dB at 250 Hz 100 and 2 KHz 106. By way of comparison, the audiogram shows relatively normal hearing at about 20 dB at 500 Hz 102 and 1 KHz 104. To restore relatively normal speech comprehension to this user, hearing at 2 KHz 106, 4 KHz 108, and 8 KHz 110 should be amplified by respective gains 120, 122, and 124 so that sounds from 250 Hz to 8 KHz over six octaves are perceived as approximately 20 dB. In particular, gain 120 should be 20 dB and gains 122 and 124 should be approximately 47 dB to restore normal hearing for speech comprehension. Hearing level 100 is between 20 dB and 30 dB and indicates only a mild hearing loss at 250 Hz. Thus, it has little effect on speech comprehension.

Figure 2:
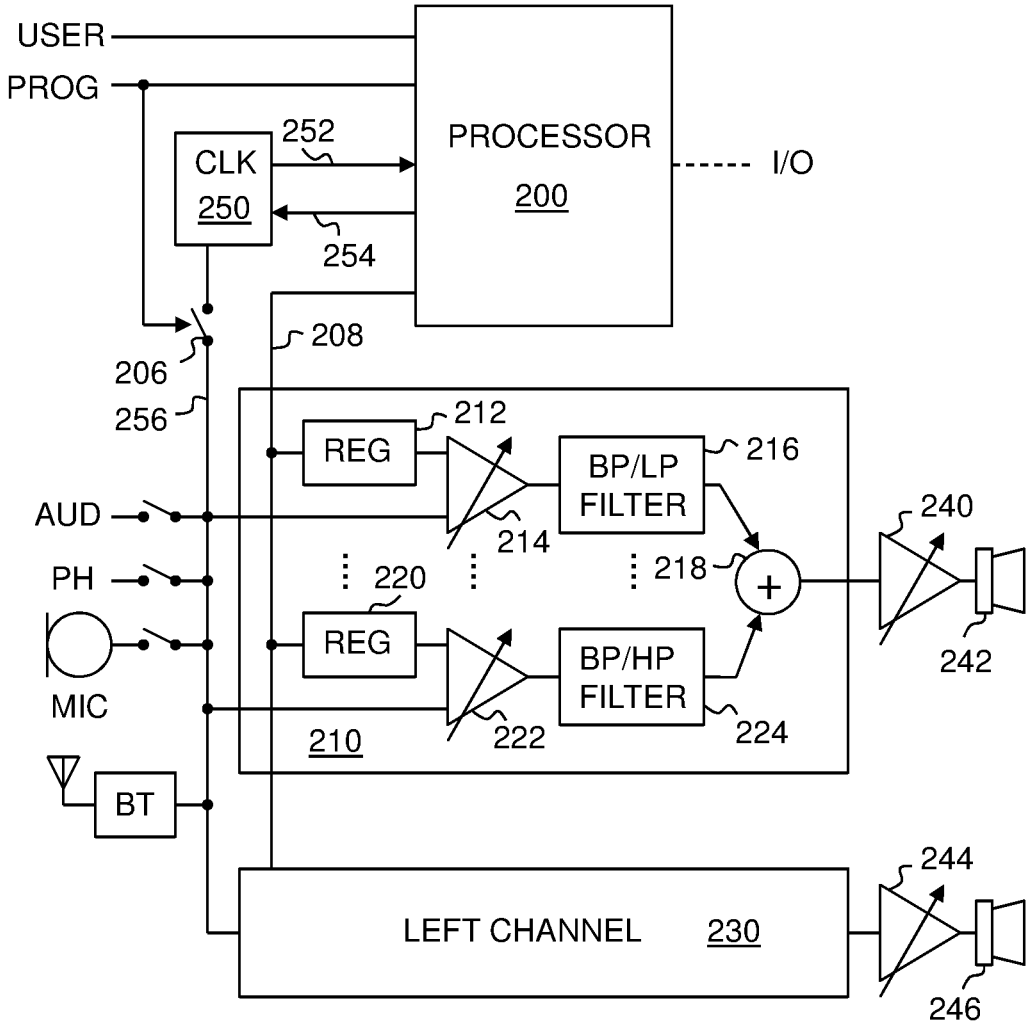
FIG. 2 is a circuit diagram of an embodiment of an audio device of the present invention having an integral hearing test.

Turning to FIG. 2, there is a circuit diagram of an embodiment of an audio device of the present invention having an integral hearing test to compensate for the deficiencies illustrated in FIG. 1. Here and in the following discussion the same reference numerals are used to indicate substantially the same elements. The circuit includes a right channel circuit 210 and a left channel circuit 230 to compensate for hearing loss in respective right and left ears. Both circuits 210 and 230 are substantially the same except for their programming. Both are controlled during a hearing test mode by processor 200, which may be a microprocessor, microcontroller, digital signal processor, or other suitable control processor. Processor 200 is optionally coupled to an input-output (I/O) port to facilitate access to nonvolatile memory by a remote computer. The circuit of FIG. 2 may be constructed from discrete components or integrated in a single integrated circuit. The circuit further includes a clock circuit 250 that applies a clock frequency to processor 200 on lead 252. Clock circuit 250 also applies various clock frequencies to circuits 210 and 230 under direction of processor 200 via lead 254 during in the hearing test mode as will be explained in detail. Circuits 240 and 244 are variable gain amplifiers that control the wide band gain of respective circuits 210 and 230. Their gain is preferably controlled by processor 200 in response to a user input such as a volume control. Their output is applied to respective hearing transducers 242 and 246. These hearing transducers are preferably ear phones or ear buds that provide some isolation from an audio source to prevent feedback. For moderate amplification, the hearing transducer may be an earphone of a cell phone or telephone handset. For greater amplification where the microphone and hearing transducer are separated by a fixed distance, such as a cell phone or telephone handset, noise cancellation circuitry (not shown) may be desirable. During normal operation, the circuit of FIG. 2 is selectively coupled by an input circuit of respective switches at lead 256 to receive signals from audio (AUD), telephone microphone (PH), or audio microphone (MIC) devices. The circuit may also be selectively coupled by a switch (not shown) to a wireless receiver such as a Bluetooth® (BT) receiver. Alternatively, the BT receiver may be directly connected to lead 256 and powered down when another input is selected.

Circuits 210 and 230 are substantially the same, so only circuit 210 will be described in detail. Circuit 210 includes several band-specific circuits. A first band-specific circuit includes register 212, variable gain amplifier (VGA) 214, and filter 216. Filter 216 is preferably tuned to a lower frequency of the audio spectrum and may be a band pass (BP) or low pass (LP) filter. A second band-specific circuit includes register 220, VGA 222, and filter 224. Filter 224 is preferably tuned to a high frequency of the audio spectrum and may be a band pass (BP) or high pass (HP) filter. Other band-specific circuits may also be included and tuned to intermediate frequencies of the audio spectrum. In some embodiments, registers 212 and 220 may be included within respective VGAs 214 and 222. Output signals from each band-specific circuit are applied to sum circuit 218 to apply a combined signal to VGA 240.

Figure 3A:
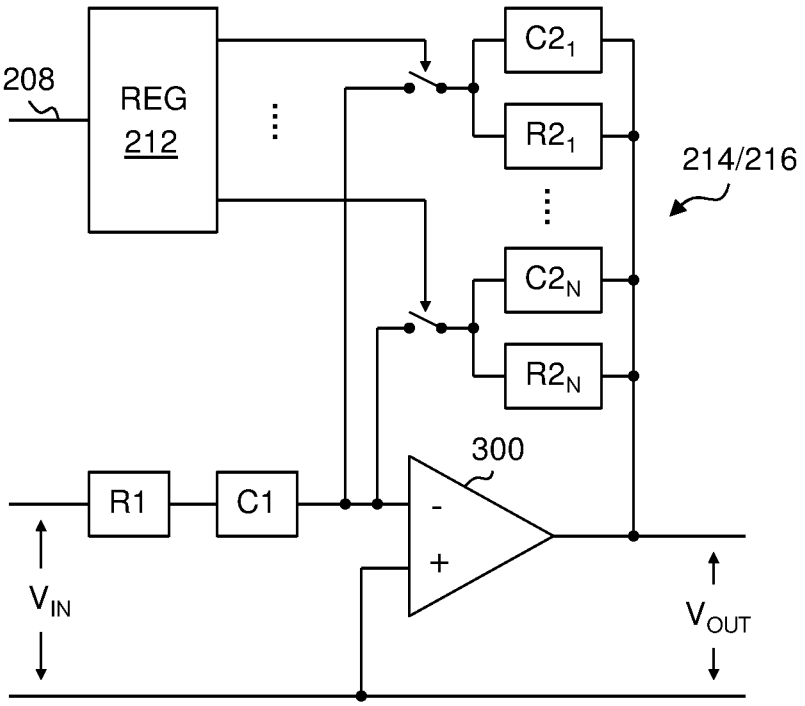
FIG. 3A is a circuit diagram of a first order active RC bandpass filter and amplifier that may be used in the circuit of FIG. 2.
Figure 3B:
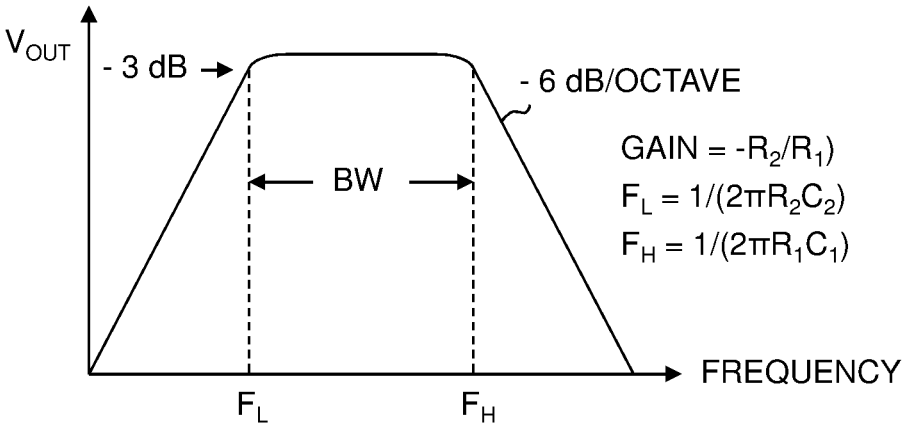
FIG. 3B is a diagram of a frequency response of the filter of FIG. 3A.

In one embodiment of the present invention, each band-specific circuit may be an active resistor-capacitor (RC) filter as in FIG. 3A having a frequency response as shown in FIG. 3B. The circuit of FIG. 3A is a first order inverting band pass filter and includes operational amplifier 300, input elements R1 and C1, and feedback elements $R2_1C2_1$ through $R2_NC2_N$. The feedback RC elements are selected by switches in response to digital values stored in register 212 by processor 200. The band pass filter is characterized by a bandwidth (BW) between a low cutoff frequency ($F_L$) and a high cutoff frequency ($F_H$). The first order filter is characterized by attenuation of −6 dB/octave outside the BW pass band. However, higher order filters with greater attenuation may be realized by additional filters connected in cascade. The gain of the filter is −R2/R1, where R2 is one of the selected feedback network elements. For example, for $F_L$=3 KHz, $F_H$=5 KHz, and GAIN=−1, values of R1=1 KΩ, C1=53.1 nF, R2=1 KΩ, and C2=31.8 nF might be selected. For a gain of −2, values of R1=1 KΩ, C1=53.1 nF, R2=2 KΩ, and C2=15.9 nF might be selected.

Figure 4A:
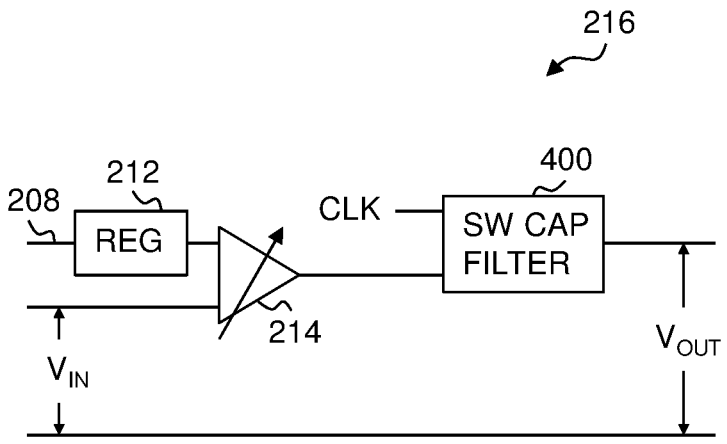
FIG. 4A is a circuit diagram of a second order switched capacitor bandpass filter and variable gain amplifier that may be used in the circuit of FIG. 2.
Figure 4B:
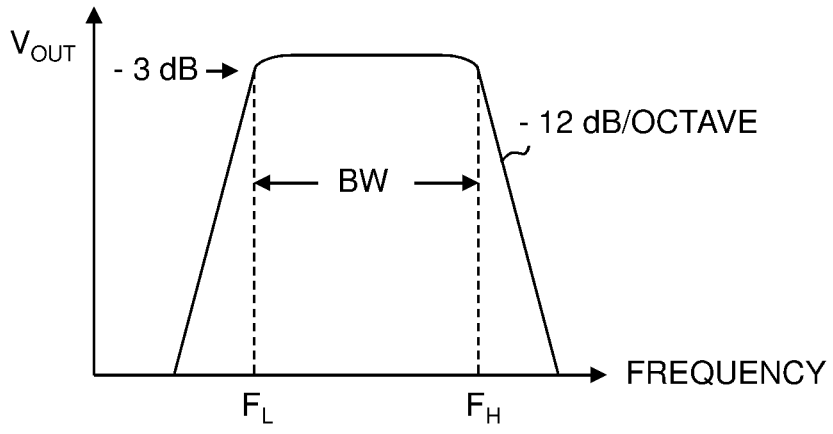
FIG. 4B is a diagram of a frequency response of the circuit of FIG. 4A.

One of the problems with active RC filters, however, is their dependence on component tolerance. In the embodiment of FIG. 4A, the band-specific circuit includes register 212, VGA 214, and switched capacitor filter 400. This embodiment advantageously reduces a dependence on component tolerance, since capacitors may be integrated by the same process. Other filter characteristics are determined by a clock (CLK) frequency. The circuit of FIG. 4A is a second order band pass filter and may be formed by two first order filters in cascade. Of course, higher order filters may be formed by adding more filters in cascade. The second order filter is characterized by attenuation of −12 dB/octave outside the BW pass band as shown at FIG. 4B and may be implemented, for example, as a Butterworth, Chebyshev, or Elliptic filter. Moreover, it may be implemented as a low pass, high pass, or band pass filter.

Figure 5:
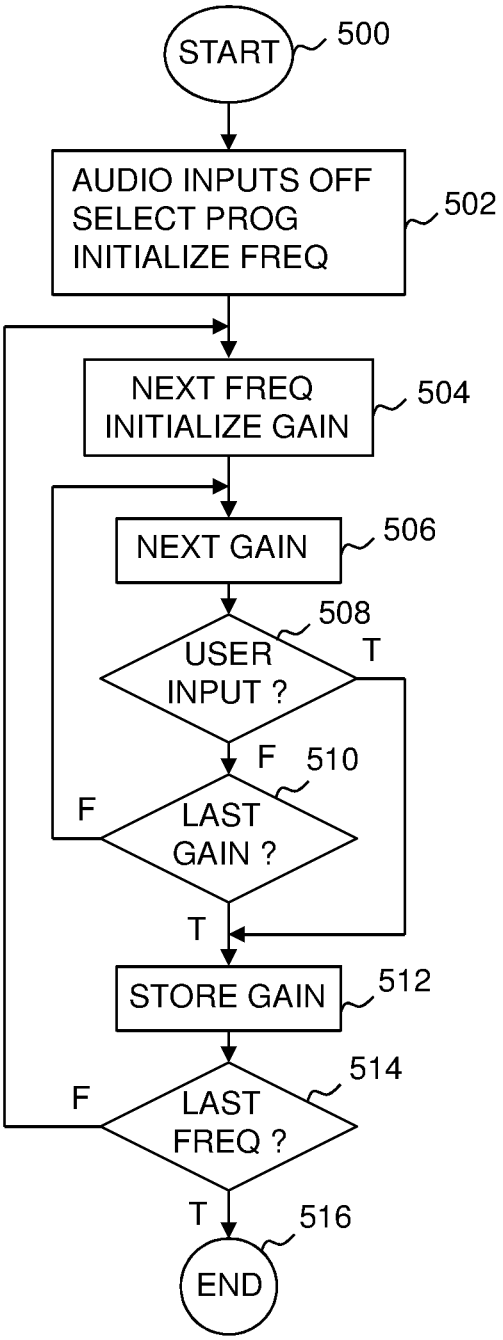
FIG. 5 is a flow chart showing programming steps of an integral hearing test according to an embodiment of the present invention.

Referring back to FIG. 2, the audio circuit is configured to operate in a hearing test mode of operation and in a normal mode of operation. The hearing test mode of operation will now be explained with reference to the flow chart of FIG. 5. The test mode is conducted with each of circuits 210 and 230, corresponding to the right and left ears. Since both tests are substantially the same, only the test for circuit 210 will be described in detail. The test begins at step 500. At step 502 input switches AUD, PH, and MIC are open as shown. A user enters the PROG signal by a key press to close switch 206 and signals processor 200 to begin the test. Processor 200 then initializes a frequency pointer. At step 504 the processor increments the frequency pointer to select the first frequency of 250 Hz and initializes a gain pointer. Of course, frequency selection may occur in any order, but the following explanation assumes an order of increasing frequency in single octave steps as in the audiogram of FIG. 1. At step 506, processor 200 writes a code word to register 212 via bus 208 to select an initial gain and directs clock circuit 250 to produce the first frequency of 250 Hz. Other band-specific circuits are disabled or set to 0 dB. Clock signals from clock circuit 250 may be sine waves or square waves. Since this is a threshold hearing test and odd harmonics are attenuated by filter 216, the user will only hear the fundamental frequency of a square wave.

The initial 250 Hz frequency at the initial gain passes through VGA 214 and filter 216 to sum circuit 218. It is amplified by VGA 240 and output to transducer 242. If the user hears this initial frequency a USER signal is entered by a key press. At step 508, processor 200 determines whether a USER input is received. If a USER signal is received, control transfers to step 512, and the gain at the current frequency is stored in nonvolatile memory of processor 200. Alternatively, if a USER signal is not received control transfers to test 510. If this is not the last gain, control transfers to block 506 and the next gain is selected preferably in order of increasing gain. When the USER signal is received, control transfers to block 512 and the gain at the current frequency is stored in nonvolatile memory of processor 200. If no USER input is received, the last gain at the current frequency is stored in nonvolatile memory of processor 200. Test 514 then determines if the current frequency is the last frequency. If not, control transfers to block 504 where processor 200 selects the next frequency and the next band-specific circuit and initializes the gain. Processor 200 repeats the process until the USER signal is received or until the greatest gain has been tested at the current frequency. Finally, when test 514 determines the last frequency has been tested and a gain is recorded for each band-specific circuit at a respective frequency, the test for circuit 210 is completed. The test is then repeated for circuit 230. Thus, a user-specific audiogram such as in FIG. 1 is recorded in nonvolatile memory of processor 200.

In a normal operation mode, switch 206 remains open and the USER input signal is ignored by processor 200. One of the audio source switches (AUD, PH, or MIC) is closed to select a respective audio source. For example, if the circuit of FIG. 2 is to be used as a telephone amplifier, the PH switch is closed and the AUD and MIC switches remain open. If the circuit of FIG. 2 is to be used to listen to a cell phone, tablet, computer, or other electronic audio source, the AUD switch is closed and the PH and MIC switches remain open. If the circuit of FIG. 2 is to be used to listen to a conversation, television, or other audible source, the MIC switch is closed to receive an input signal from a microphone (MIC). Switches AUD and PH remain open. When the circuit of FIG. 2 is powered up, processor 200 writes code words stored in nonvolatile memory to each respective register (212 through 220) in circuits 210 and 230 via bus 208. This adjusts the gain of each band-specific circuit to approximately a normal perceived hearing level for the user. Thereafter, audio signals from a selected source (AUD, PH, or MIC) are amplified by band-specific circuits of circuit 210, summed by circuit 218 and applied to VGA 240 and hearing transducer 242. The same operation occurs in parallel for circuit 230, VGA 244, and hearing transducer 246 with respective gain code words for band-specific circuits.

Figure 6:
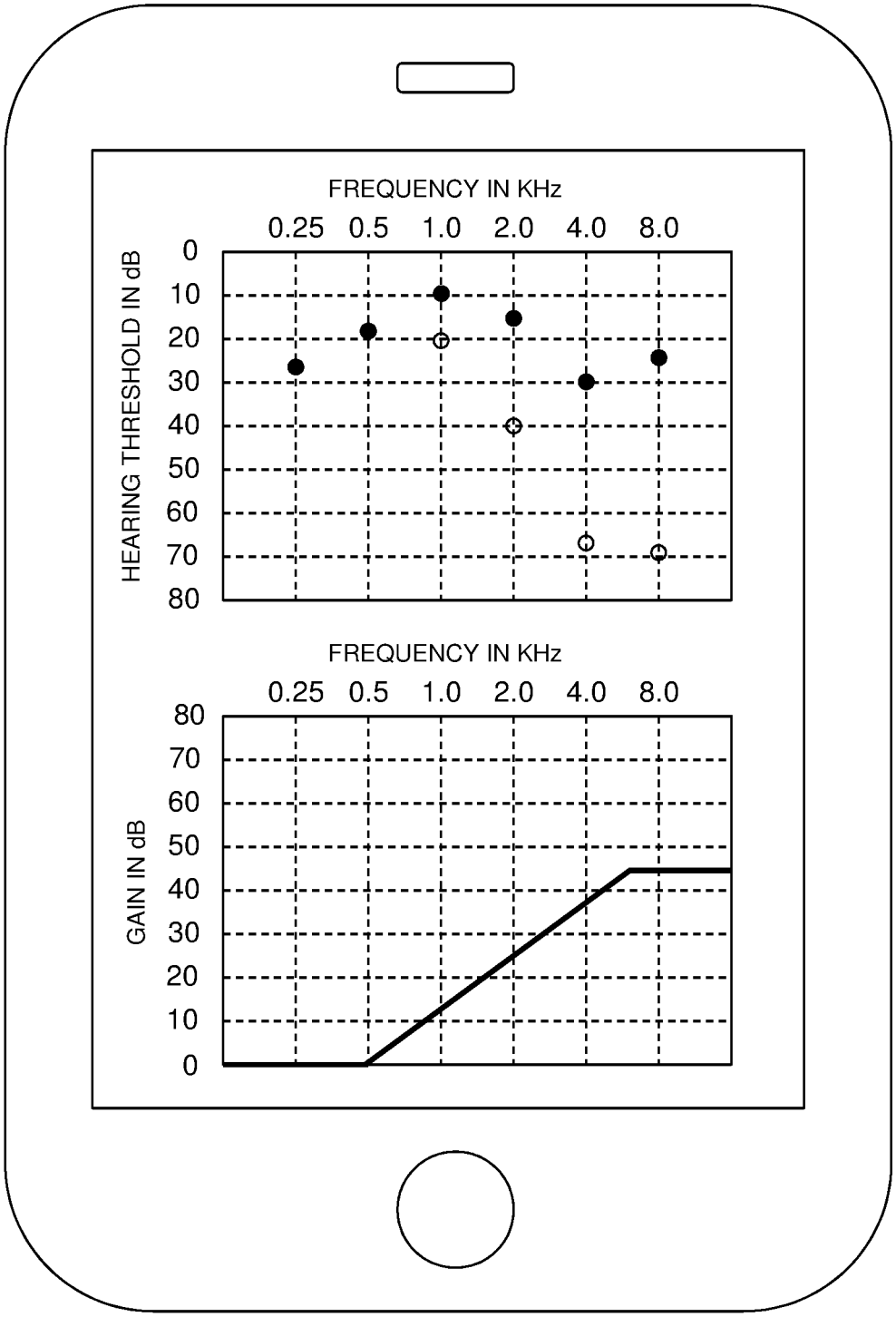
FIG. 6 is a display of an audiogram and the corresponding frequency response of the circuit of FIG. 2 as implemented in a portable electronic device such as a cell phone or tablet.

Referring next to FIG. 6, there is a display of an audiogram and the corresponding frequency response of the circuit of FIG. 2 as implemented in a portable electronic device such as a cell phone or tablet. The audiogram of FIG. 1 is reproduced in the upper graph as circles without infill. These are points identified by the hearing test of FIG. 5 and are stored in nonvolatile memory of processor 200. These points may be accessed via the optional I/O port for display on a laptop or desktop computer for applications other than a cell phone or tablet. The lower graph illustrates the gain of circuit 210 or 230 as determined by the programming of individual band-specific circuits. Circles with solid infill in the upper graph indicate the sound level perceived by the user at each octave after the band-specific gain of the lower graph is applied. For example, a gain of 45 dB is applied at 8 KHz to increase the measured user response from the hearing test (69 dB) to a perceived level of 24 dB. Other band-specific circuits are disabled or their gain set to 0 dB. The 8 KHz band-specific circuit includes a second order high pass filter and attenuates frequencies outside the pass band (BW) at −12 dB/octave. Thus, the 8 KHz band-specific circuit applies a gain of 38 dB at 4 KHz for a perceived level of 30 dB, a gain of 24 dB at 2 KHz for a perceived level of 16 dB, and a gain of 12 dB at 1 KHz for a perceived level of 9 dB. The user with impaired hearing, therefore, will perceive sounds from 250 Hz to 8 KHz as though they are in a relatively normal range of 9 dB to 30 dB.

Figure 7:
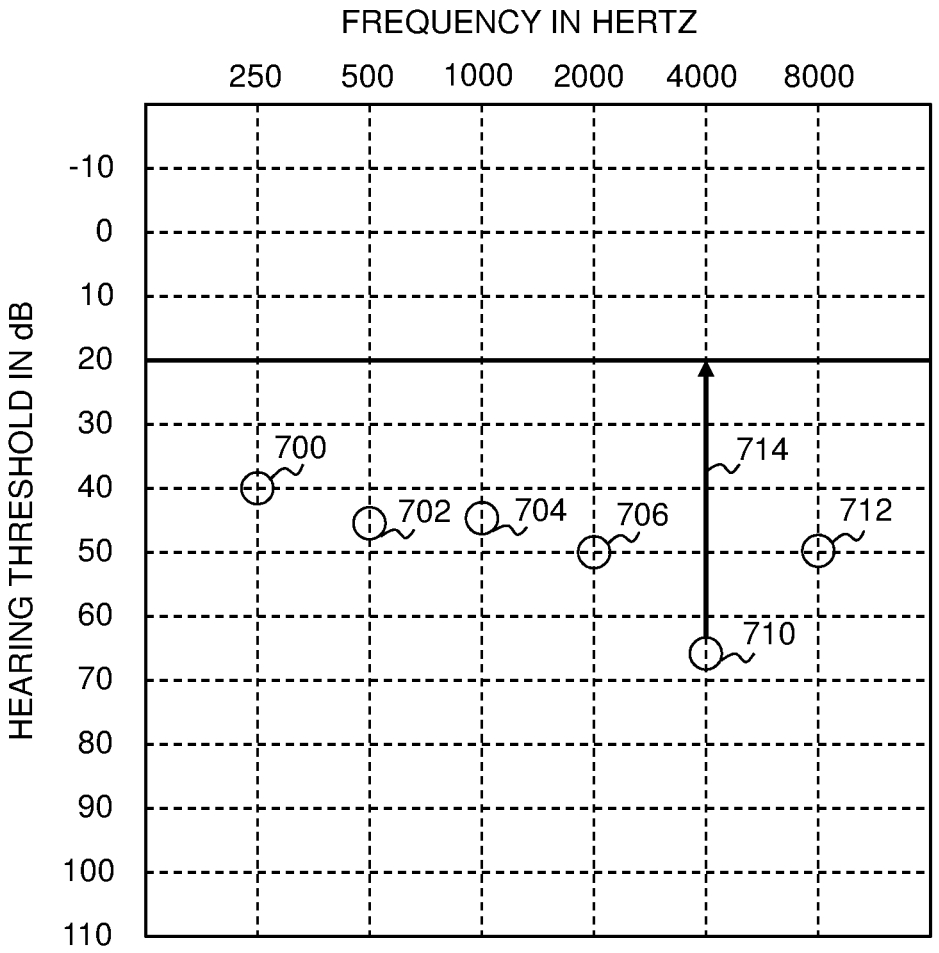
FIG. 7 is another audiogram of a user showing moderate hearing loss in both mid-range and high frequency regions.

Referring now to FIG. 7, there is another audiogram of a user showing moderate hearing loss in both mid-range and high frequency regions. The audiogram shows a measured hearing level of 67 dB at 4 KHz 710 and a relatively constant hearing loss at all other frequencies 700, 702, 704, 706, and 712. Thus, a gain 714 of 40 dB at 4 KHz and a gain of approximately 20 dB at other frequencies would provide a relatively normal perceived hearing level in the range of 10 dB to 30 dB.

Figure 8:
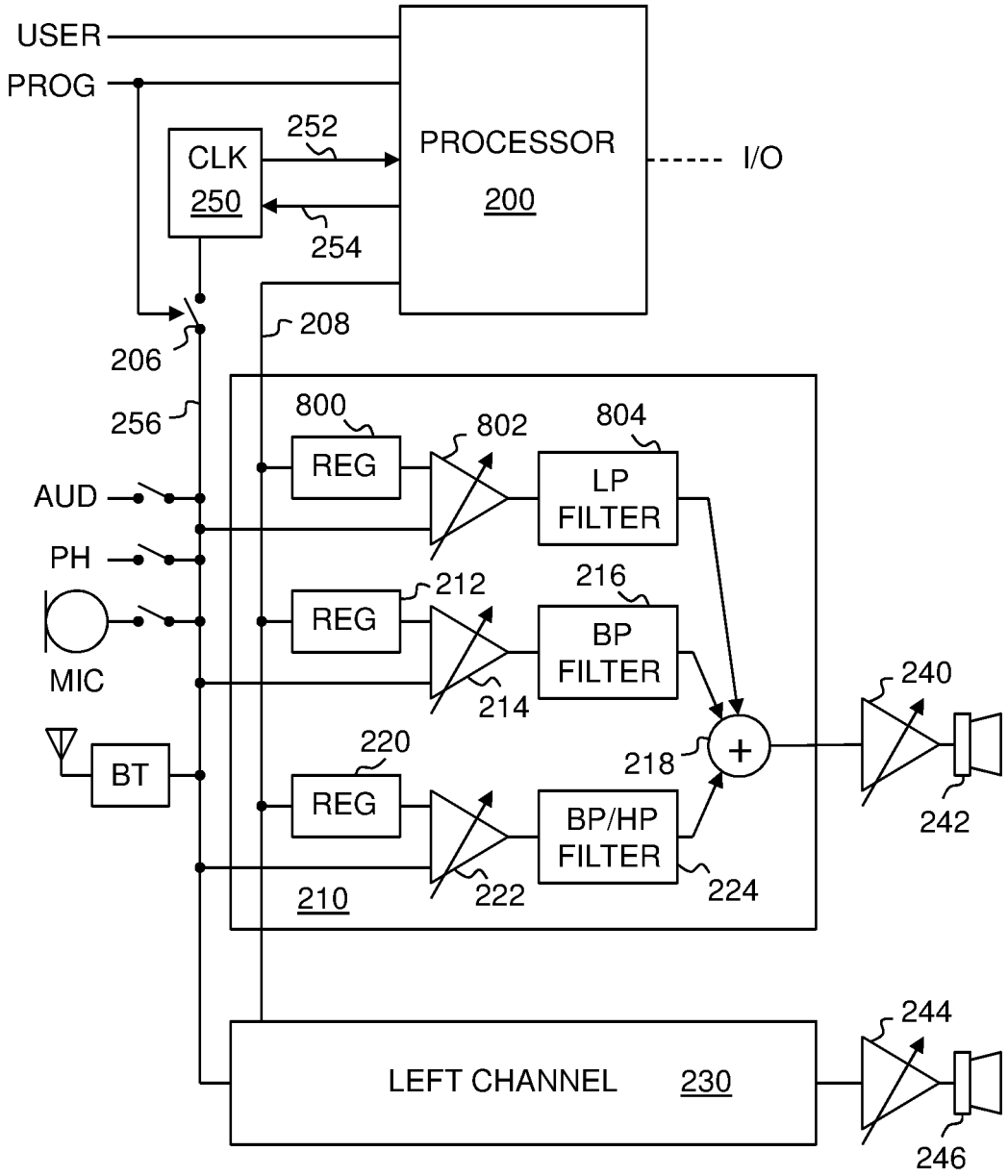
FIG. 8 is a circuit diagram of another embodiment of an audio device of the present invention having an integral hearing test.

The circuit of FIG. 8 is similar to the circuit of FIG. 2 except for the addition of a band-specific circuit including register 800, VGA 802, and low pass filter 804. This band-specific filter 804 includes a higher cutoff frequency than the circuit of FIG. 2 to accommodate frequencies below 1 KHz. The band-specific circuit including register 212, VGA 214, and band pass filter 216 is tuned to pass 4 KHz, and the band-specific circuit including register 220, VGA 222, and band pass filter 224 is tuned to pass 8 KHz. A gain of 40 dB is applied to the 4 KHz band-specific circuit, since it is the lowest measured hearing level in the 2 KHz to 8 KHz range.

Figure 9:
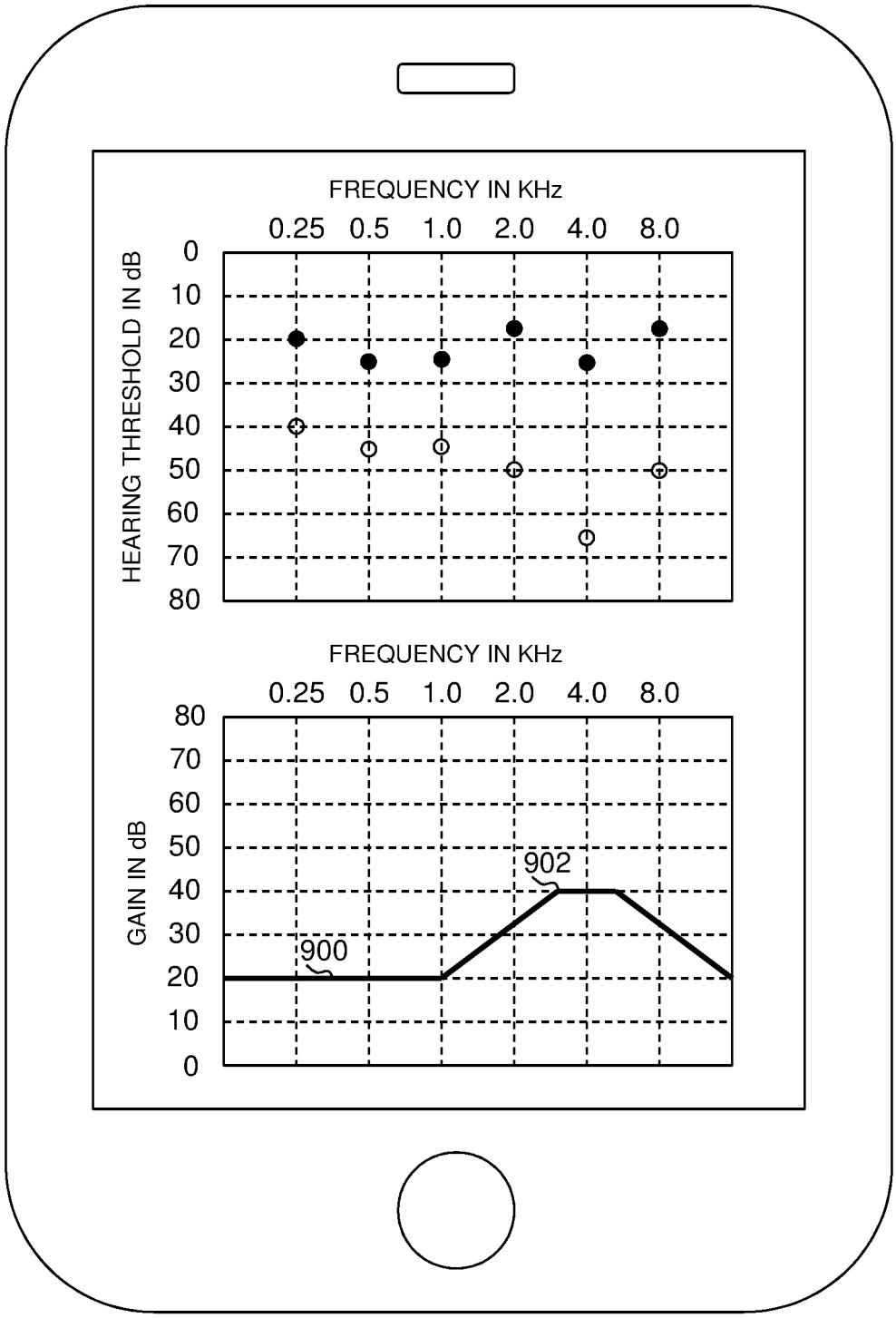
FIG. 9 is a display of an audiogram and the corresponding frequency response of the circuit of FIG. 8 as implemented in a portable electronic device such as a cell phone or tablet.

FIG. 9 is a display of an audiogram and the corresponding frequency response of the circuit of FIG. 8 as implemented in a portable electronic device such as a cell phone or tablet. The audiogram of FIG. 7 is reproduced in the upper graph as circles without infill. These are points identified by the hearing test of FIG. 5 and are stored in nonvolatile memory of processor 200. They may be accessed via the optional I/O port for display on a laptop or desktop computer. The lower graph illustrates the gain of circuit 210 or 230 as determined by the programming of individual band-specific circuits. Circles with solid infill in the upper graph indicate the sound level perceived by the user at each octave after the band-specific gain of the lower graph is applied. For example, a gain of 20 dB 900 is applied to low frequencies from 250 Hz to 1 KHz. This increases the measured user response from the hearing test to a perceived level of 20 dB at 250 Hz, 26 dB at 500 Hz, and 25 dB at 1 KHz. A gain of 40 dB 902 is applied at 4 KHz to increase the measured user response from the hearing test (66 dB) to a perceived level of 26 dB. The 2 KHz and 8 KHz band-specific circuits are either disabled or their gain set to 0 dB. The 4 KHz band-specific circuit includes a second order high pass filter and attenuates frequencies outside the pass band (BW) at −12 dB/octave. Thus, the 4 KHz band-specific circuit applies a gain of 32 dB at 2 KHz and 8 KHz for a perceived level of 18 dB at each respective frequency. The user with impaired hearing, therefore, will perceive sounds from 250 Hz to 8 KHz as though they are in a relatively normal range of 18 dB to 26 dB.

Figure 10A:
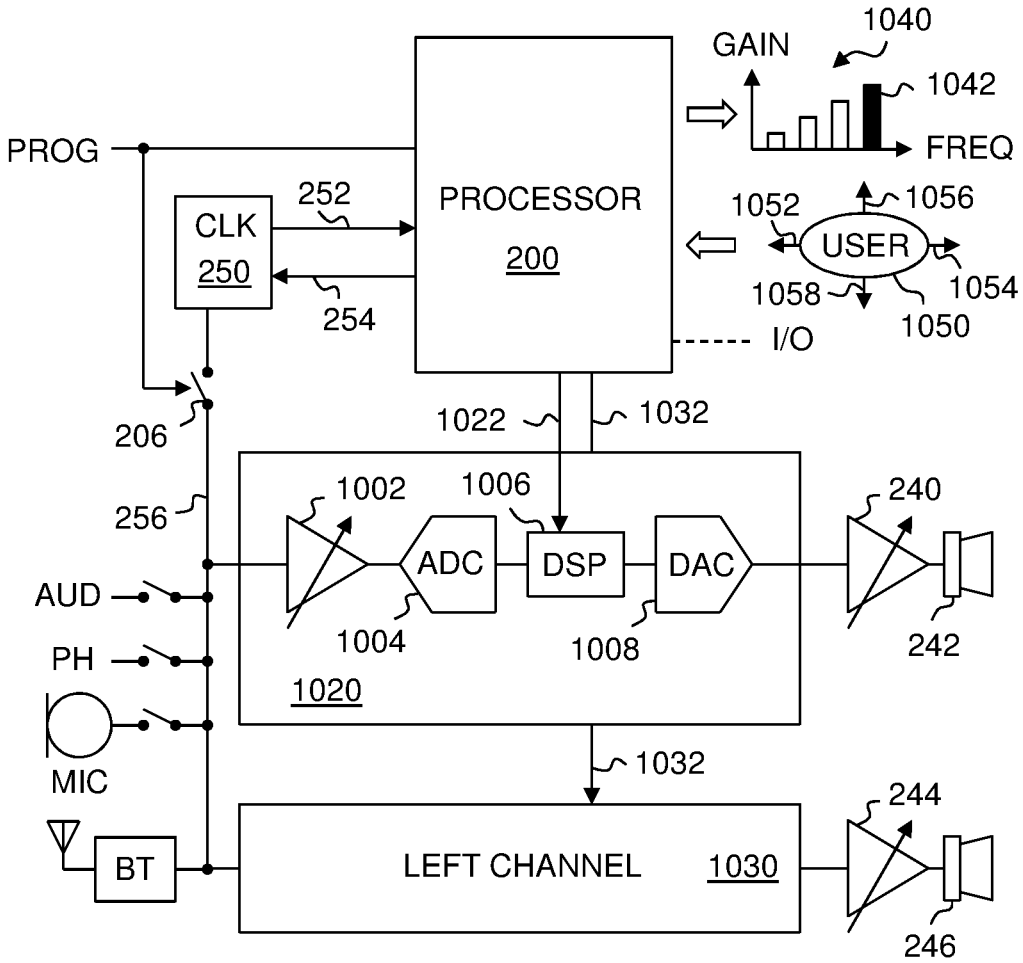
FIG. 10A is a circuit diagram of yet another embodiment of an audio device of the present invention utilizing a digital signal processing circuit and having an integral hearing test.

Turning now to FIG. 10A, there is a circuit diagram of another embodiment of an audio device of the present invention having an integral hearing test. This circuit is similar to the circuit of FIG. 2 except that the right 1020 and left 1030 channels utilize digital signal processing circuitry. Both channels 1020 and 1030 are the same except for their respective programming, so only the right channel 1020 will be described in detail. Channel 1020 receives a selected analog audio input signal on lead 256 as previously described. The analog audio input signal is applied to VGA 1002, which serves as a wide band preamplifier for weak audio signals. VGA 1002 provides an amplified audio signal to analog-to-digital converter (ADC) 1004. ADC 1004 converts the analog input signal to a digital signal which is applied to digital signal processor (DSP) 1006. DSP 1006 receives programming signals from processor 200 on bus 1022. Likewise a DSP in channel 1030 receives respective programming signals on bus 1032. DSP 1006 may be configured as a plurality of frequency-selective digital filters in response to programming signals on bus 1022. These digital filters may be BiQuad filters, finite impulse response (FIR) filters, infinite impulse response (IIR) filters, or a combination of these or other appropriate filters as is known to those of ordinary skill in the art. For example, a TLV320AIC3256™ audio encoder-decoder (CODEC) made by Texas Instruments Incorporated includes such a programmable digital filter. Moreover, each filter may be programmed with respective gain and cutoff frequencies corresponding to respective center frequencies. DSP 1006 applies a filtered digital output signal to digital-to-analog converter (DAC) 1008. DAC 1008 converts the filtered digital signal to a corresponding analog audio output signal having programmed frequency specific gains. The analog audio output signal from DAC 1008 is applied to VGA 240 as previously described.

The circuit of FIG. 10A also includes a display 1040 coupled to receive signals from processor 200. Display 1040 may be a LCD bar graph to display a programmed gain of each frequency as indicated by small rectangles without infill. The display also indicates a frequency with solid infill 1042 that is being programmed in program mode. Display 1040 may be a window of a cell phone or tablet or may be a separate LCD display coupled to processor 200. The circuit of FIG. 10A further includes a multi-switch with a user input key 1050 as previously described. Input keys 1052 or 1054 may be pressed to respectively decrease or increase a selected frequency in display 1040 for programming. Input keys 1056 or 1058 may be pressed to respectively increase or decrease the gain at the selected frequency until a user determines a hearing threshold for that frequency. A gain at each respective frequency is selected by a key press of user input 1050. The selected gain at each frequency is stored in nonvolatile memory of processor 200 as previously described. When programming is complete, the user presses the PROG key to return to normal mode. The embodiment of FIG. 10A advantageously displays the gain and frequency being programmed without the need to step through every gain and frequency. This embodiment also permits a user to increase or decrease a gain at each frequency to accurately determine a hearing threshold.

Figure 10B:
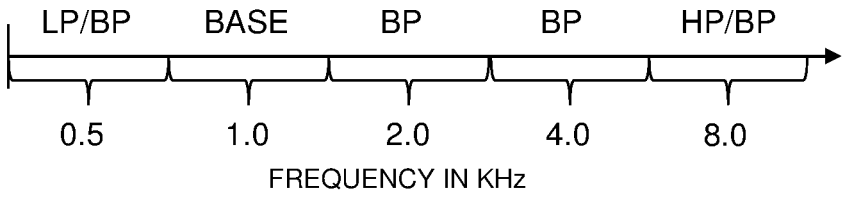
FIG. 10B is a diagram showing filter selectivity at respective frequency bands.

FIG. 10B is a diagram showing respective frequencies and filter selectivity at respective frequency bands for the circuit of FIG. 10A. During initial programming a gain of VGA 1002 is adjusted to a user hearing threshold for a base frequency of 1 KHz while all frequency-selective filters are set to a gain of 0 dB. The user then programs each frequency band to a hearing threshold as previously described. For example, a first filter may be a low pass (LP) or bandpass (BP) filter having an upper cutoff frequency of 0.75 KHz. A second filter may be a BP filter having cutoff frequencies of 1.5 KHz and 3.0 KHz. A third filter may also be a BP filter having cutoff frequencies of 3.0 KHz and 6.0 KHz. A final filter may be a high pass (HP) or BP filter having a lower cutoff frequency 6.0 KHz. This method advantageously provides frequency selective filter programming for five octaves with only four programmed filters.

Embodiments of the present invention provide several advantages over hearing devices of the prior art. The previously described hearing tests permit a user to program embodiments of FIG. 2, 8, or 10 to fit their individual level of hearing loss. Moreover, the user can reprogram an embodiment to compensate for further hearing loss over time. The described embodiments are also suitable for use with many audio applications. For example, the AUD input may be used with any audio device that would use head phones or ear buds. The PH input may be used when an embodiment is used as a telephone amplifier. The MIC input may be used when an embodiment is used as a hearing device to aid in normal conversation or listening to television. The BT input may be used to receive audio signals from a wireless receiver such as a Bluetooth® receiver. Embodiments of the present invention may be included in cell phones, tablets, laptop or desktop computers, telephone handsets, or virtually any portable electronic device. Finally, embodiments of the present invention may advantageously be fabricated in a single integrated circuit for very low power portable devices.

Still further, while numerous examples have thus been provided, one skilled in the art should recognize that various modifications, substitutions, or alterations may be made to the described embodiments while still falling with the inventive scope as defined by the following claims. For example, filters of band-specific circuits may be fourth order or higher. Hearing test points may be measured at more or less frequencies than once each octave. Gains of band-specific circuits may be positive or negative. Embodiments of the present invention may be incorporated in virtually any portable electronic device to compensate various degrees of hearing loss. Other combinations will be readily apparent to one of ordinary skill in the art having access to the instant specification.

What is claimed is:

1. A circuit, comprising:
- a plurality of variable gain amplifiers (VGAs) coupled to receive an audio signal;
- a switch to select the audio signal from a plurality of sources in a normal mode;
- a plurality of filters, each filter coupled to a respective VGA and configured to filter an output signal from the respective VGA; and
- a processor coupled to the VGAs and configured to apply a respective audio frequency to each VGA in a test mode to determine a respective Pain for each VGA based on user input
- and to apply the respective gain to each VGA in the normal mode.

2. The circuit of claim 1, comprising a clock circuit configured to apply the respective audio frequency to each VGA in the test mode.

3. The circuit of claim 1, wherein the processor is configured to control the respective gain of each VGA in the test mode.

4. The circuit of claim 1, wherein the respective audio frequency of each VGA is filtered by the respective filter coupled to the VGA in the test mode.

5. The circuit of claim 1, comprising:
- a sum circuit coupled to receive the filtered output signal from each filter and produce a sum signal; and
- an output VGA coupled to receive the sum signal and produce an output signal.

6. The circuit of claim 1, wherein the audio signal is produced during the normal mode by at least one of a portable electronic device, a telephone handset, and a microphone.

7. The circuit of claim 1, comprising a wireless receiver configured to produce the audio signal.

8. A method of operating a circuit, comprising:
- applying a first audio frequency to a first band-specific circuit in a test mode of operation;

incrementing a first gain of the first band-specific circuit by a processor until a user input is received;

displaying the first audio frequency and the first gain;

storing the first gain in a nonvolatile memory of the processor in response to the user input; and applying the first gain to the first band-specific circuit by the processor during a normal mode of operation.

9. The method of claim 8, comprising:

applying a plurality of audio frequencies to a respective plurality of band-specific circuits in the test mode of operation after the step of applying a first audio frequency;

incrementing a gain of each of the plurality of band-specific circuits by a processor until a respective user input is received;

displaying the plurality of audio frequencies and their respective gains;

storing each respective gain in the nonvolatile memory of the processor in response to the respective user input; and applying each respective gain to each of the plurality of band-specific circuits by the processor during a normal mode of operation.

10. The method of claim 8, comprising:

applying an input signal from a portable electronic device to the first band-specific circuit in the normal mode of operation;

amplifying the input signal by the first band-specific circuit at the first gain;

filtering the input signal by the first band specific circuit; and producing the amplified and filtered input signal at a hearing transducer.

11. The method of claim 8, comprising:

applying an input signal from a telephone handset to the first band-specific circuit in the normal mode of operation;

amplifying the input signal by the first band-specific circuit at the first gain;

filtering the input signal by the first band specific circuit; and producing the amplified and filtered input signal at a hearing transducer of the telephone handset.

12. The method of claim 8, comprising:

applying an input signal from a microphone to the first band-specific circuit in the normal mode of operation;

amplifying the input signal by the first band-specific circuit at the first gain;

filtering the input signal by the first band specific circuit; and producing the amplified and filtered input signal at a hearing transducer.

13. The method of claim 8, comprising:

applying an input signal from a wireless receiver to the first band-specific circuit in the normal mode of operation;

amplifying the input signal by the first band-specific circuit at the first gain;

filtering the input signal by the first band specific circuit; and producing the amplified and filtered input signal at a hearing transducer.

14. The method of claim 8, comprising:

displaying a hearing threshold of the user in response to the user input; and displaying the first gain in response to the test mode of operation.

15. A circuit, comprising:

a plurality of band-specific circuits coupled to receive a respective audio frequency in a test mode and produce a respective band-specific output signal;

a processor configured to store a gain of each respective band-specific output signal in response to a respective user input signal;

a switch to select an audio signal from a plurality of sources in a normal mode; and an input circuit configured to apply the audio signal to each band-specific circuit during the normal mode, wherein each band-specific circuit produces a respective normal mode output signal having the respective stored gain.

16. The circuit of claim 15, wherein the plurality of band-specific circuits comprises a digital signal processor.

17. The circuit of claim 15, wherein the plurality of band-specific circuits comprises at least one of a BiQuad filter, a finite impulse response (FIR) filter, and an infinite impulse response (IIR) filter.

18. The circuit of claim 15, wherein at least one of the band-specific circuits comprises a low pass filter, and wherein at least another of the band specific circuits comprises a high pass filter.

19. The circuit of claim 15, configured to receive the signal applied to each band-specific circuit during the normal mode from at least one of a portable electronic device, a telephone handset, a microphone, and a wireless receiver.

20. The circuit of claim 15, comprising:

a display configured to display the gain and audio frequency of the band-specific output signal; and a switch circuit configured to select the gain and audio frequency of the band-specific output signal.

* * * * *

UNITED STATES PATENT AND TRADEMARK OFFICE

CERTIFICATE OF CORRECTION

PATENT NO. : 10,375,489 B2
APPLICATION NO. : 15/816950
DATED : August 6, 2019
INVENTOR(S) : Robert Newton Rountree, Sr.

It is certified that error appears in the above-identified patent and that said Letters Patent is hereby corrected as shown below:

In the Claims

Column 8, Line 41, Claim 1, delete "Pain" and insert --gain--.

Signed and Sealed this
Tenth Day of September, 2019

Andrei Iancu

Andrei Iancu
*Director of the United States Patent and Trademark Office*